United States Patent [19]

Qualley

[11] Patent Number: 4,834,368

[45] Date of Patent: May 30, 1989

[54] PORTABLE BASKETBALL NET

[76] Inventor: Paul Qualley, 30 W. 74th St. - Apt. 3B, New York, N.Y. 10023

[21] Appl. No.: 113,706

[22] Filed: Oct. 28, 1987

[51] Int. Cl.[4] ..... A63B 63/08

[52] U.S. Cl. ..... 273/1.5 R; 43/11

[58] Field of Search ..... 273/1.5, 400–402; 43/11; 210/471, 495, 497.2

[56] References Cited

U.S. PATENT DOCUMENTS

| | | | |
|---|---|---|---|
| 3,761,089 | 9/1973 | Slane | 273/1.5 R X |
| 3,814,359 | 6/1974 | Powell | 273/400 X |
| 4,082,269 | 4/1978 | Hill | 273/1.5 R |
| 4,169,331 | 10/1979 | Baker | 43/11 |

*Primary Examiner*—Paul E. Shapiro

*Attorney, Agent, or Firm*—Wolder, Gross & Yavner

[57] ABSTRACT

A portable basketball net assembly which may be easily installed upon and removed from a basketball goal hoop includes a flexible collar which embraces the goal hoop circumference. The extended edges of the collar are selectively joinable as are the opposed ends of the collar to retain the collar in place on the hoop. A net depends from the collar and fully surrounds the hoop when the collar is installed. The edges and ends of the collar are preferably joinable by mating sections of hook-and-eye fabric tape material.

2 Claims, 2 Drawing Sheets

PORTABLE BASKETBALL NET

BACKGROUND OF THE INVENTION

The present invention relates generally to a basketball net unit and, more particularly, to a new and improved basketball net unit which may be easily installed upon and removed from a basketball hoop and which may be carried by the user.

Basketball courts form a familiar part of the outdoor landscape. Particularly in urban areas, a basketball court provides needed recreation and social interaction for a diverse spectrum of the population. Due to the popularity of basketball as a form of recreation, the basketball goal net, which is typically formed of a cord-like material, such as nylon rope, in addition to being subject to the ravages of the environment, often becomes the subject of mischief, resulting in the deterioration of the net material and its ultimate removal or destruction. Various other net materials, including metal mesh works, are sometimes utilized, but such materials, in addition to having characteristics somewhat different from a cord net, can be injurious to the hands of players if contact with the net material occurs. In addition, despite the more substantial construction of such nets, they too are subject to the rigors of the environment. Once a net disappears from the basketball hoop, a significant portion of the "essence" of the game departs. In addition, the lack of a net and its retarding action upon the travel of the ball once it has passed through the goal hoop makes it somewhat more difficult to determine when a goal has been scored.

BRIEF SUMMARY OF THE INVENTION

It is accordingly a purpose of the present invention to provide a basketball net assembly which may be easily installed and removed from a basketball goal hoop, thus allowing the players to have a facility which maintains the traditional character of the game, while at the same time avoiding the disadvantages of a permanently-affixed net.

In accordance with the above and other purposes, the present invention consists of a flexible collar which may be affixed in an embracing relationship about a basketball goal hoop and selectively maintained thereon. The collar is provided with opposed complimentary grip means which are selectively connectable to maintain the collar about the hoop. Further connection means maintain the ends of the collar proximate each other to maintain the collar about the entire hoop circumference. Affixed to the collar is a mesh net, which, when the collar is installed, depends from the circumference of the hoop in a conventional manner.

DESCRIPTION OF THE DRAWINGS

A fuller understanding of the present invention may be obtained upon consideration of the following description of a preferred, but nonetheless illustrative, embodiment of the invention when taken in conjunction with the annexed drawings, wherein.

DESCRIPTION OF A PREFERRED EMBODIMENT

Figure 1:
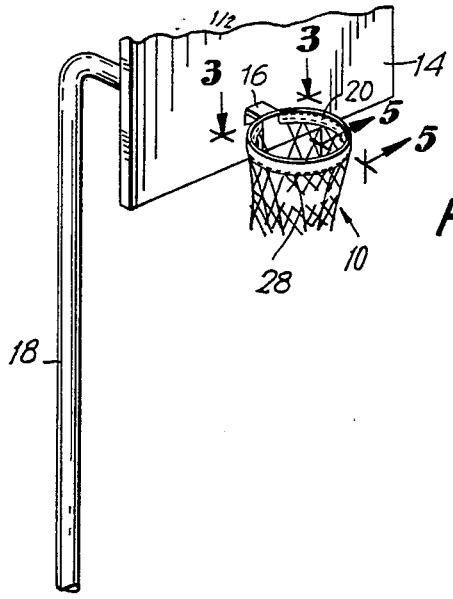
FIG. 1 is a perspective view of the present invention installed upon a basketball goal hoop.

Referring initially to FIG. 1, the improved net apparatus 10 of the present invention is installed upon goal hoop 12, which is mounted to backboard 14 by mounting bracket 16. The entire goal and backboard assembly is supported at the appropriate height over the playing surface or floor by mounting pole 18.

Figure 2:
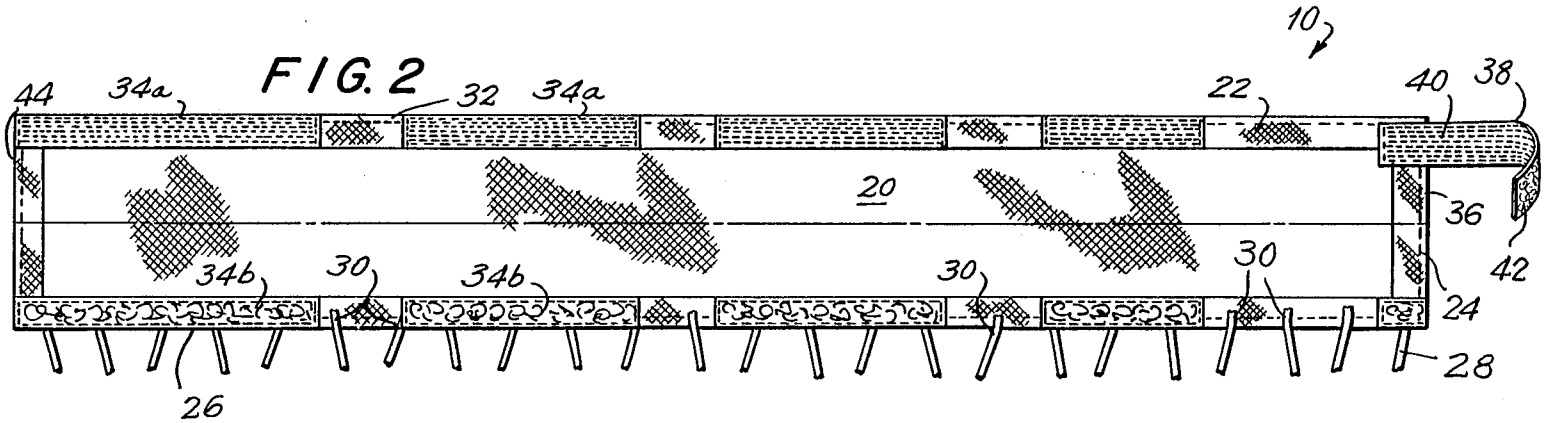
FIG. 2 is an elevational view of the collar portion of the invention.

As may be seen in FIG. 2, apparatus 10 includes attachment means in the form of a rectangular collar member 20 whose length approximates the circumference of goal hoop 12 as measured from one side of bracket 16 to the other. This length is normally about 56 inches. Collar member 20 may be formed from a variety of flexible, sheet-like materials having the desired strength characteristics. In a preferred embodiment, the material may be a nylon fabric which, in addition to having physical strength, is relatively impervious to varied weather conditions. The width of the collar is such that it may be easily wrapped around the goal hoop 12. It has been determined that a width of approximately 8½ inches is advantageous. An exterior seam 22 may be formed about the periphery of the collar to both strengthen the material and provide a non-fraying edge. Such a peripheral seam may be secured by one or more lines stitching 24 or any other manner known in the art.

Mounted proximate the lower extended edge 26 of the collar is woven net 28. The net 28 is of conventional construction, and may be formed of a series of interconnected nylon cords. The upper edge of the net may be secured along the lower edge 26 of collar 20 by stitching of the ends of the individual net cords 30 to the collar member.

Located along both the lower extended edge 26 and the upper extended edge 32 of collar member 20 are complimentary grip means units 34*a,b*. The grip means units 34*a,b* are placed at intervals along the length of the collar vertically aligned to each other, and may preferably consist of mating pieces of complimentary hook-and-eye fabric tape sold under the trademark Velcro. Alternatively, other complimentary grip means, such as pairs of snap-fasteners, may be located along the collar edges. The grip means may be fastened to the collar by any appropriate means. For "Velcro" type means, sewing of the units may be utilized.

Extending from a first end 36 of the collar is tab 38, which also may be formed of an appropriate sheet-like material. In a preferred embodiment, where grip means 34*a,b* are of hook-and-eye fabric tape, tab 38 consists of complimentary lengths of similar hook-and-eye fabric tape joined together whereby the active surfaces are facing outward. Tab 38 is advantageously located proximate upper extended edge 32 of the collar, and has first surface 40 engageable with complimentary grip means 34*b* and second surface 42 engageable with complimentary grip means 34*a*. When installed on the goal hoop, tab 38 may be utilized to join the ends 36 and 44 of the collar, thus insuring that the collar fully surrounds the hoop.

Figure 5:
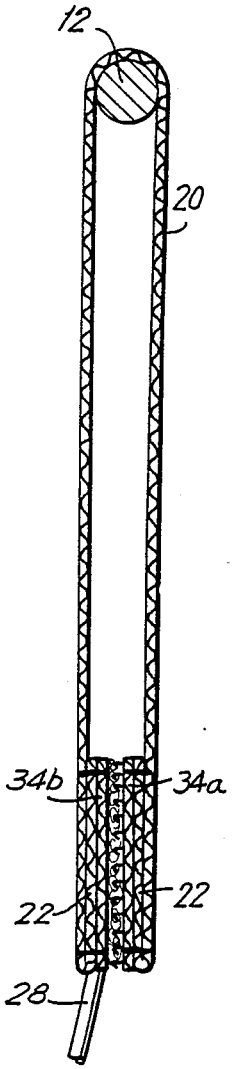
FIG. 5 is a sectional view taken along line 5—5 of FIG. 1 further illustrating how the collar embraces the goal hoop and supports the goal net.
Figure 3:
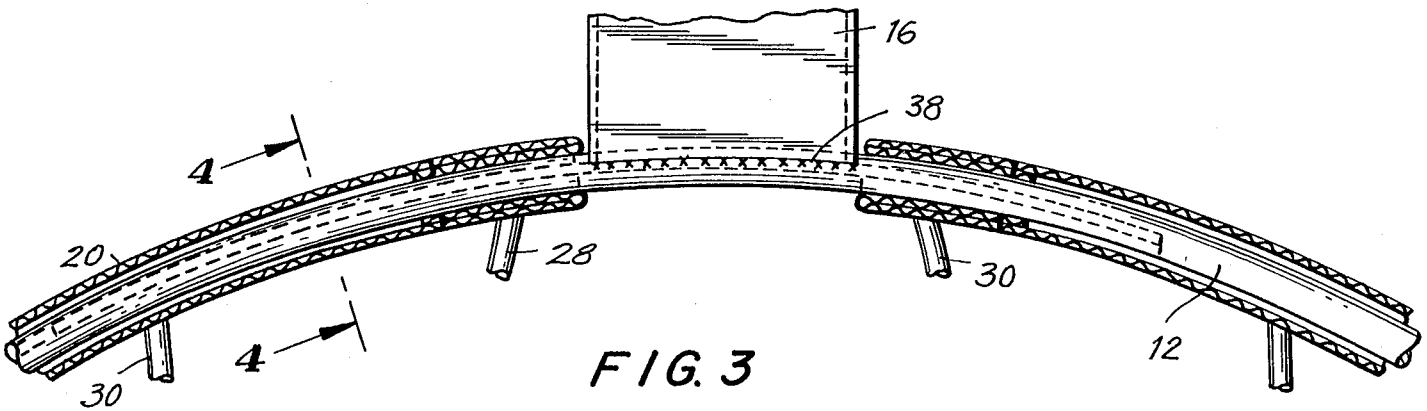
FIG. 3 is a top partial sectional plan view taken along line 3—3 in FIG. 1 showing the apparatus in place on a goal hoop.

As best seen in FIG. 5, removable net apparatus 10 is installed upon goal hoop 12 such that collar member 20 is wrapped around and embraces goal hoop 12 whereby complimentary grip means 34*a,b* are aligned and placed in contact along the length of the collar. When so positioned, net 28 depends from the collar and wraps entirely about the goal hoop, the ends of the collar being located adjacent hoop mounting bracket 16, as shown in FIG. 3.

Figure 4:
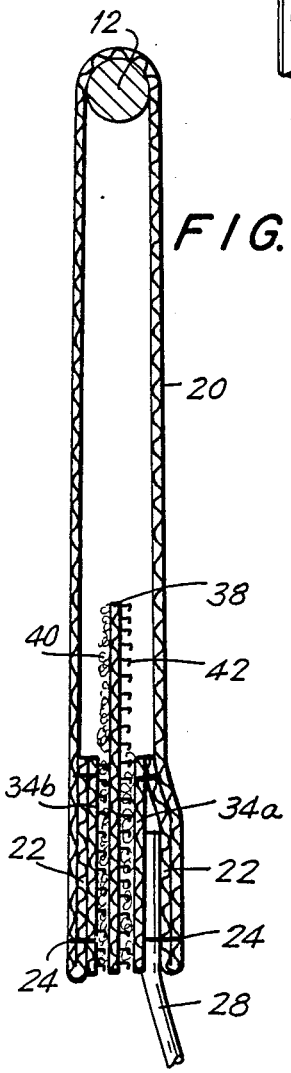
FIG. 4 is a sectional elevational view taken along line 4—4 in FIG. 3 detailing the interconnection of the ends of the collar.

When so installed upon the goal hoop 12, tab 38 may then be utilized to retain the collar 20 about the entire periphery of the hoop. As may be seen in FIG. 4, tab 38 is inserted between the complimentary grip means 34*a,b* proximate end 44 of the collar. As tab surfaces 40, 42 are mateable with the adjacent grip means 34*a,b,* the tab 38 is maintained in contact therewith, thus maintaining the ends 36, 44 of the collar 26 adjacent each other on opposite sides of bracket 16 and providing a complete net loop.

Fully installed upon the goal hoop, net apparatus 10 serves as a conventional net, with the added advantage of providing a more clearly seen target, as collar 20, which may be a bright color, such as orange, clearly and distinctly outlines the hoop rim. When it is desired to be removed from the hoop, however, the complimentary grip means 34*a,b,* as well as tab 38, can easily be disengaged from each other and the apparatus removed from the goal hoop. As the apparatus is formed essentially completely of flexible materials, it may be folded or otherwise manipulated into a form which allows for ease of transportation. The net may accordingly be carried by an individual for re-installation as desired. Additionally, as the net is advantageously formed of materials having some degree of resistance to the elements, it may remain installed, if desired, for an extended period of time without suffering detrimental effects.

What is claimed is:

1. A basketball net assembly adapted to be affixed to a basketball goal hoop, comprising a rectangular attachment collar portion having a length approximately equal to the circumference of said goal hoop, said attachment collar being formed of a flexible sheet material; first and second complementary grip means located along opposed extended edges of said collar portion, said grip means adapted to selectively retain said extended edges together whereby said goal hoop is embraced by said collar portion; mating attachment means located on the opposed ends of said collar to maintain said collar about the circumference of said goal hoop; and a mesh net mounted to one of said extended edges of said collar portion such that said net assembly substantially encircles and depends from said goal hoop.

2. The apparatus of claim 1, wherein said mating attachment means comprise a tab of sheet material projecting from a first end of said collar, said tab bearing hook elements on a first surface thereof and eye elements on a second surface thereof, said hook-and-eye elements being mateable with said complimentary grip means portions proximate the second end of said collar.

* * * * *